US011306488B1

(12) United States Patent
Mantzoor

(10) Patent No.: US 11,306,488 B1
(45) Date of Patent: Apr. 19, 2022

(54) BASEBOARD

(71) Applicant: Zohar Mantzoor, Boca Raton, FL (US)

(72) Inventor: Zohar Mantzoor, Boca Raton, FL (US)

( * ) Notice: Subject to any disclaimer, the term of this patent is extended or adjusted under 35 U.S.C. 154(b) by 70 days.

(21) Appl. No.: 16/839,926

(22) Filed: Apr. 3, 2020

Related U.S. Application Data

(60) Provisional application No. 62/948,206, filed on Dec. 14, 2019.

(51) Int. Cl.
*E04F 19/04* (2006.01)
*E04F 19/06* (2006.01)

(52) U.S. Cl.
CPC ..... *E04F 19/06* (2013.01); *E04F 19/0459* (2013.01)

(58) Field of Classification Search
CPC ... E04F 19/02; E04F 19/0468; E04F 19/0463; E04F 19/0495; E04F 19/0472; E04F 19/0477; E04F 19/0945; E04F 19/04; E04F 19/0436; E04F 2019/0404; E04F 2019/0409; E04F 2019/0413; E04F 2019/0418; E04F 2019/0422; E04F 2019/0431; E04F 2019/044; E04F 2019/0445; E04B 2/82
USPC ..... 52/287.1, 288.1
See application file for complete search history.

(56) References Cited

U.S. PATENT DOCUMENTS 4,086,734 A 5/1978 Hayashi
4,622,791 A * 11/1986 Cook ..... E04B 2/825 52/241
5,901,516 A * 5/1999 Watson ..... E04B 2/7453 52/242
6,282,855 B1 * 9/2001 Shipton ..... E04F 19/045 52/287.1
D574,513 S 8/2008 Vibiano
7,793,483 B2 * 9/2010 Stanchfield ..... E04F 15/02027 52/716.1
8,534,017 B1 * 9/2013 Schroeter ..... E04F 19/0468 52/288.1
9,021,766 B1 * 5/2015 Hayes ..... E04G 23/0203 52/745.2
2007/0017174 A1 * 1/2007 Lavell ..... E04F 19/04 52/267
2014/0137496 A1 * 5/2014 Fletcher ..... E04F 19/0459 52/287.1
2016/0215508 A1 * 7/2016 Kimel ..... E04F 19/0477
2018/0371766 A1 * 12/2018 Anzalone, Jr. ..... E04F 19/0477
(Continued)

*Primary Examiner* — Kyle J. Walraed-Sullivan
(74) *Attorney, Agent, or Firm* — Sanchelima & Associates, P.A.; Christian Sanchelima; Jesus Sanchelima

(57) ABSTRACT

A protective baseboard including a baseboard assembly and a stopper assembly, along with a methodology for installing the protective baseboard is disclosed. The baseboard assembly includes a baseboard with a rear side. On the rear side of the baseboard is a stopper member of the stopper assembly extending along a bottom edge of the baseboard. The stopper member extends outwardly and away from the baseboard, giving the baseboard a substantially L shape. The baseboard is mounted on a ground surface and the drywall is mounted atop the stopper member. The stopper member extends entirely across the lower edge of the drywall. The stopper member creates a barrier between the drywall and the ground surface to prevent water on the ground surface from seeping into the drywall which leads to costly and dangerous water damage to the drywall.

1 Claim, 7 Drawing Sheets

(56) References Cited

U.S. PATENT DOCUMENTS

Figure 1:
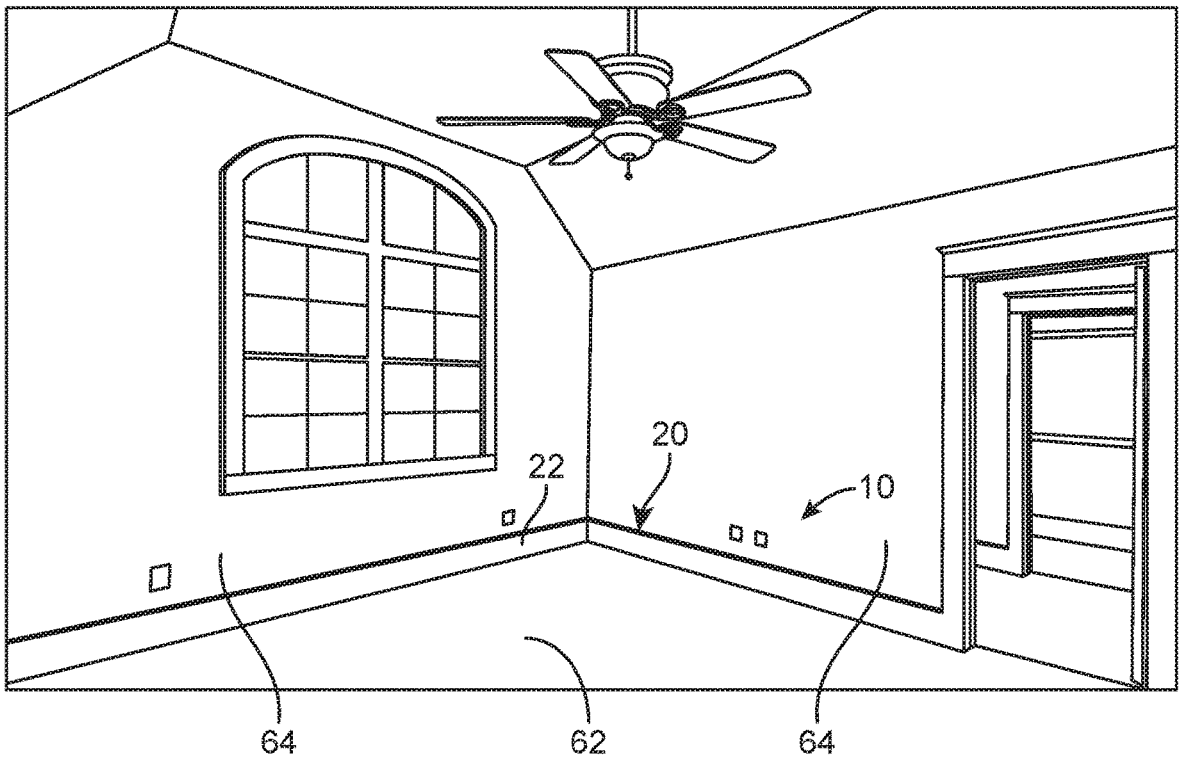

| | | | | |
|---|---|---|---|---|
| 2019/0177983 | A1* | 6/2019 | Klein | F16B 5/128 |
| 2019/0186156 | A1* | 6/2019 | Bertovic | E04F 19/0481 |

* cited by examiner

BASEBOARD

1. OTHER RELATED APPLICATIONS

The present application is a continuation-in-part/divisional of U.S. Patent Application No. 62/948,206, filed on Dec. 14, 2019, which is hereby incorporated by reference.

2. FIELD OF THE INVENTION

The present invention relates to a baseboard and, more particularly, to a baseboard that includes a barrier along a bottom edge of the baseboard to prevent water from seeping into a drywall mounted atop the baseboard.

3. DESCRIPTION OF THE RELATED ART

Several designs for baseboards have been designed in the past. None of them, however, include a baseboard having stopper member, which creates a barrier, that extends outwardly and away from the baseboard along a bottom of the baseboard, the barrier prevents water from seeping into a drywall that is mounted atop of the stopper member of the baseboard. The present invention reduces the need for costly repairs and maintenance by preventing drywall from enduring water damage. This helps to prolong the lifespan of the drywall. Further, the baseboard helps to improve the health of the user by reducing the chances of mold or other similar fungus from developing on the drywall, due to the water damage, which can be harmful to the user.

Applicant believes that a related reference corresponds to U.S. Pat. No. 4,086,734 for an adjustable-height baseboard for a partition which includes a rail member adapted to being mounted on a floor. Applicant believes that another related reference corresponds with U.S. Pat. No. 8,534,017 for devices and methods for preventing baseboard tilt associated with fastening a baseboard to a wall panel having a recessed edge. Applicant believes yet another reference corresponds with U.S. patent No. D574,513 for a floor/wall finish molding. None of these references, however, teach of a baseboard with a stopper member on a rear side that creates a barrier between a drywall mounted onto the stopper member and a ground surface to prevent water from seeping or soaking into the drywall.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a baseboard that helps to prevent water from seeping into a drywall to help eliminate water damage occurring to the drywall.

It is another object of this invention to provide a baseboard that creates a barrier between a drywall and a ground surface.

It is still another object of the present invention to provide a baseboard that helps to prolong the lifespan of a drywall.

It is still yet another object of the present invention to provide a baseboard that helps to reduce the likelihood of fungus developing on the drywall due to water damage which helps to increase the safety and health of the user.

It is also another object of the present invention to provide a baseboard that helps to reduce costly repairs and maintenance to a drywall.

It is yet another object of this invention to provide such a device that is inexpensive to implement and maintain while retaining its effectiveness.

It is still another object of the present invention to provide a methodology for installing a baseboard in such a manner that a drywall is entirely above a barrier of the baseboard.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an operational setting in which the baseboard 22 is mounted between a ground surface 62 and a drywall 64 to prevent water damage from occurring to the drywall 64.

Figure 2:
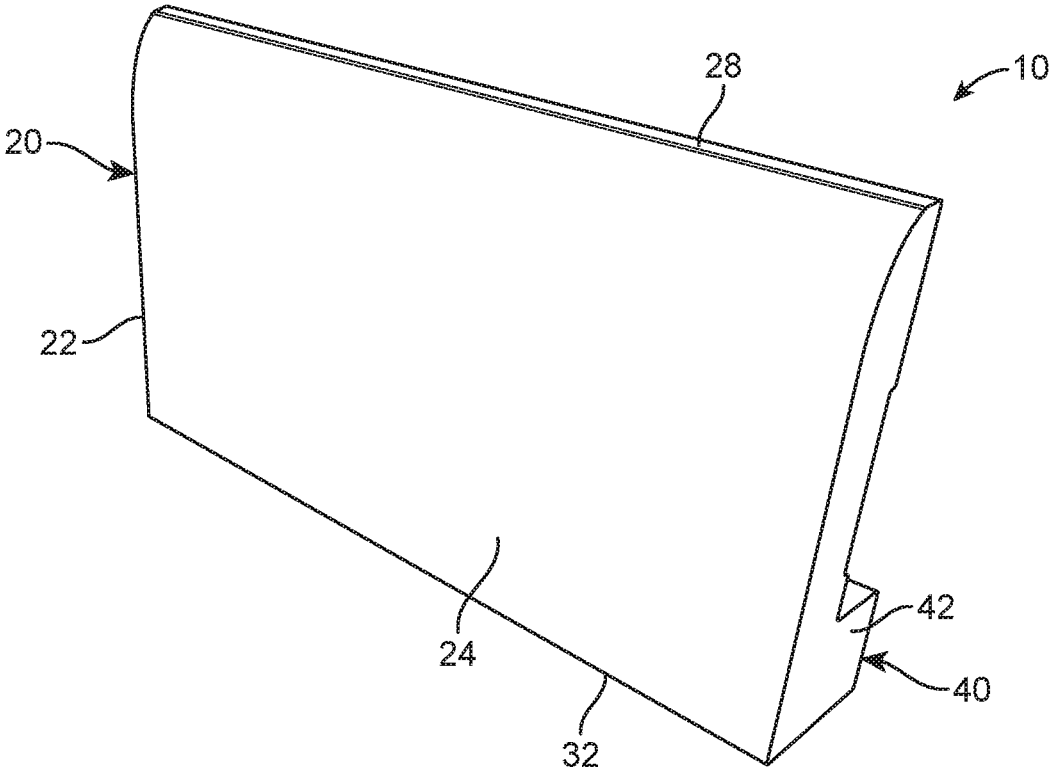

FIG. 2 shows an isometric view of the baseboard 22.

Figure 3:
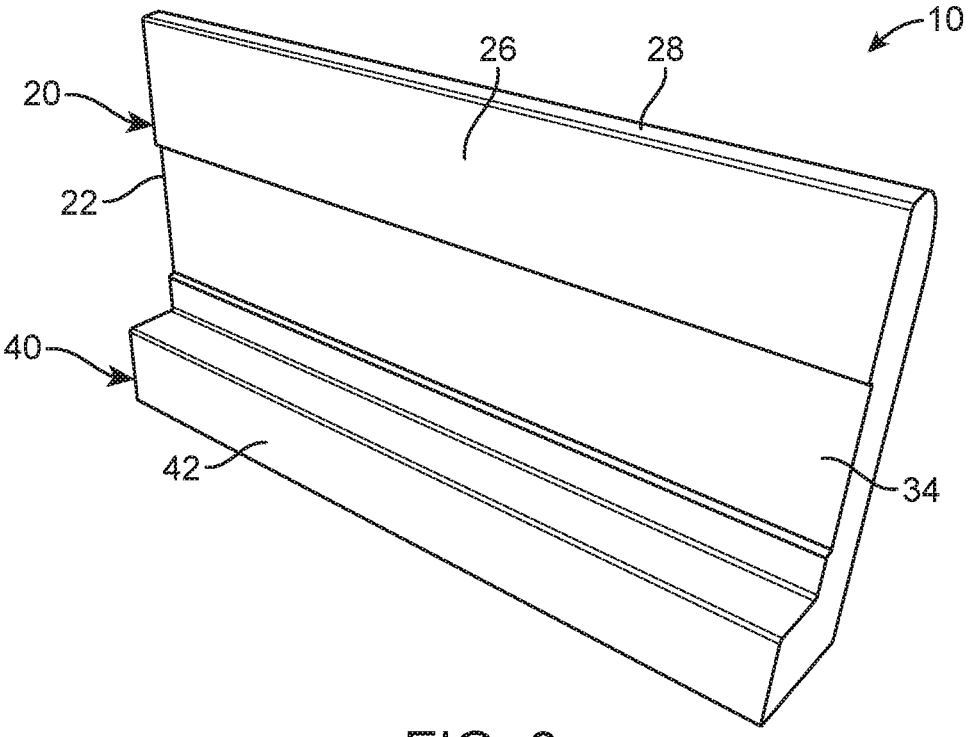

FIG. 3 illustrates an isometric rear view of the baseboard 22 showing the stopper member 42 mounted to the rear side 26 of the baseboard 22.

Figure 4:
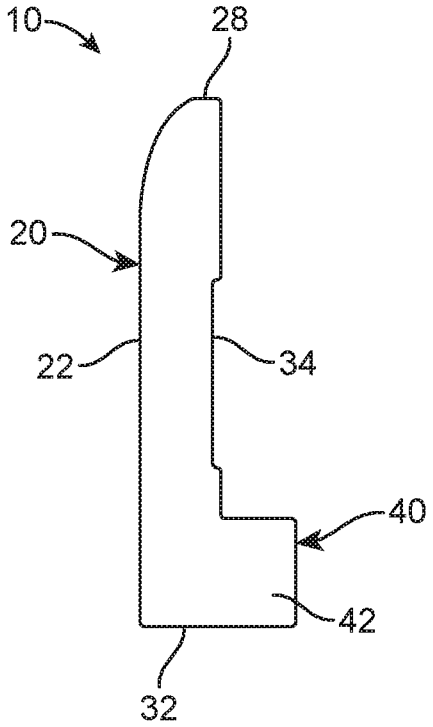

FIG. 4 is a representation of a side view of the baseboard 22 showing the stopper member 42.

Figure 5:
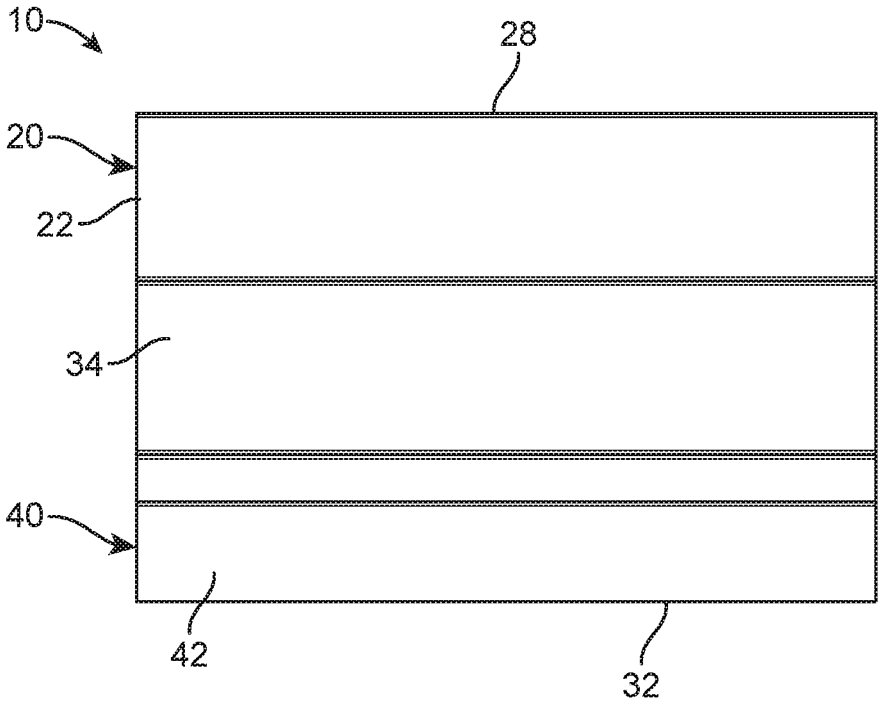

FIG. 5 represents a rear view of the baseboard 22 with stopper member 42 extending across the baseboard 22.

Figure 6:
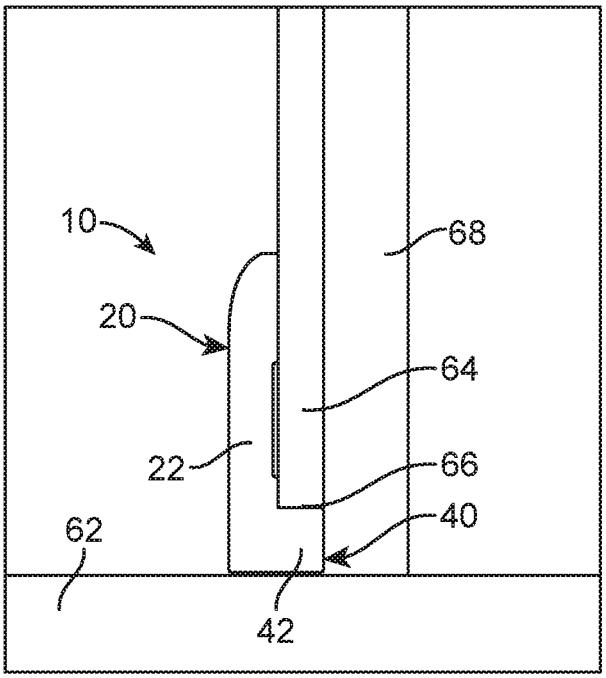

FIG. 6 shows a side view of the baseboard 22 within the drywall 64 atop of the stopper member 42.

Figure 7:
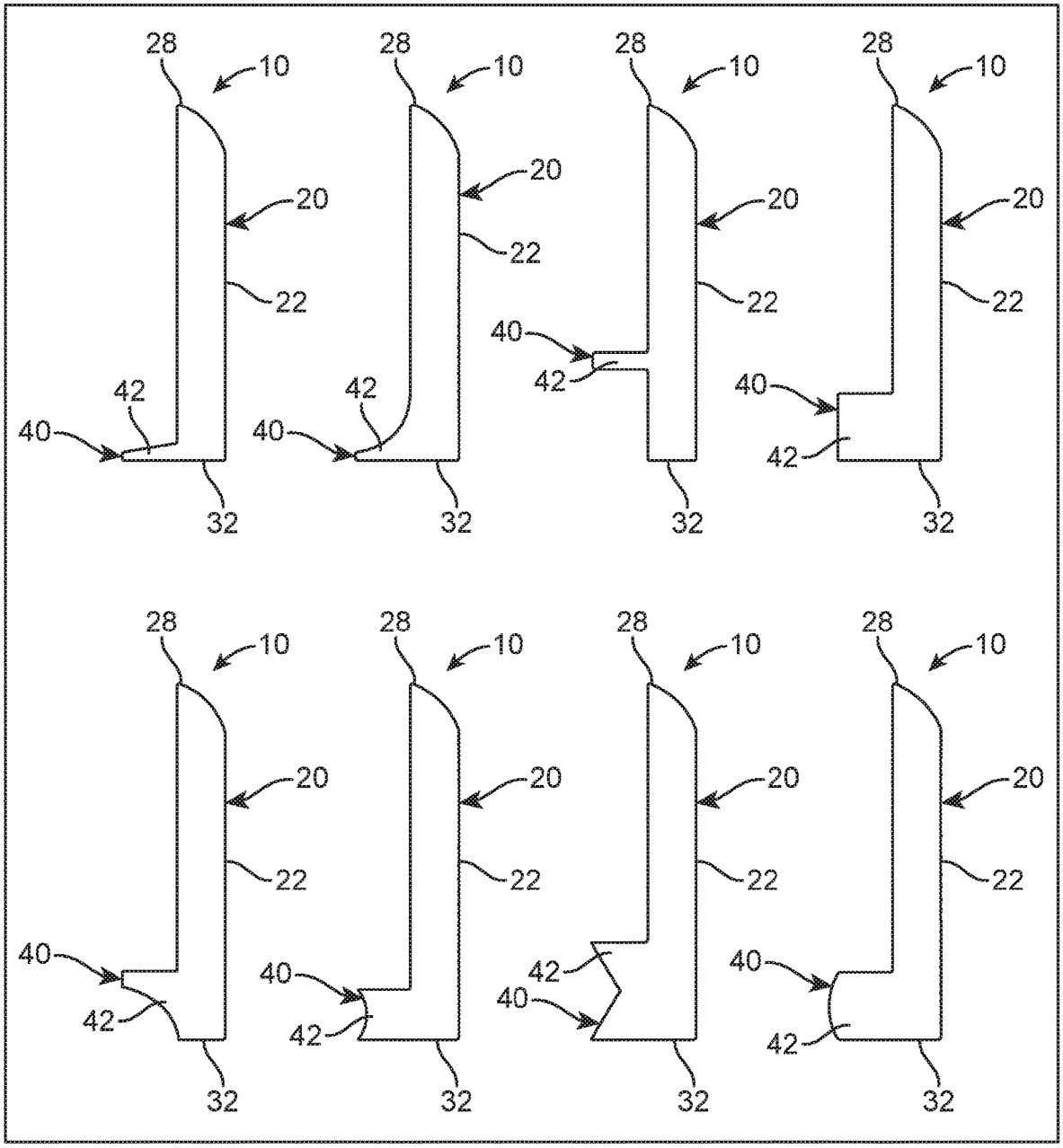

FIG. 7 represents a side view of the baseboard 22 in alternate embodiments, wherein the stopper member 42 is shown in different designs.

Figure 8:
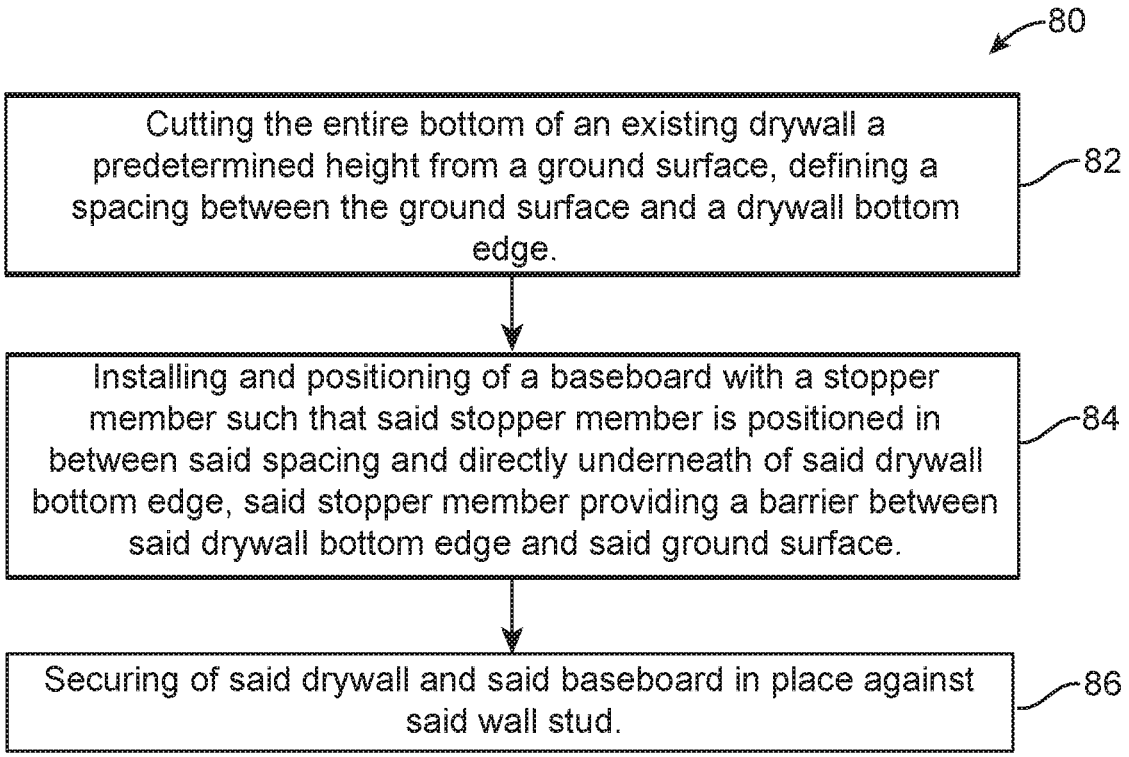

FIG. 8 illustrates the method 80 and the steps necessary to properly install the protective baseboard 10 when drywall 64 is already exiting and installed in place.

Figure 9:
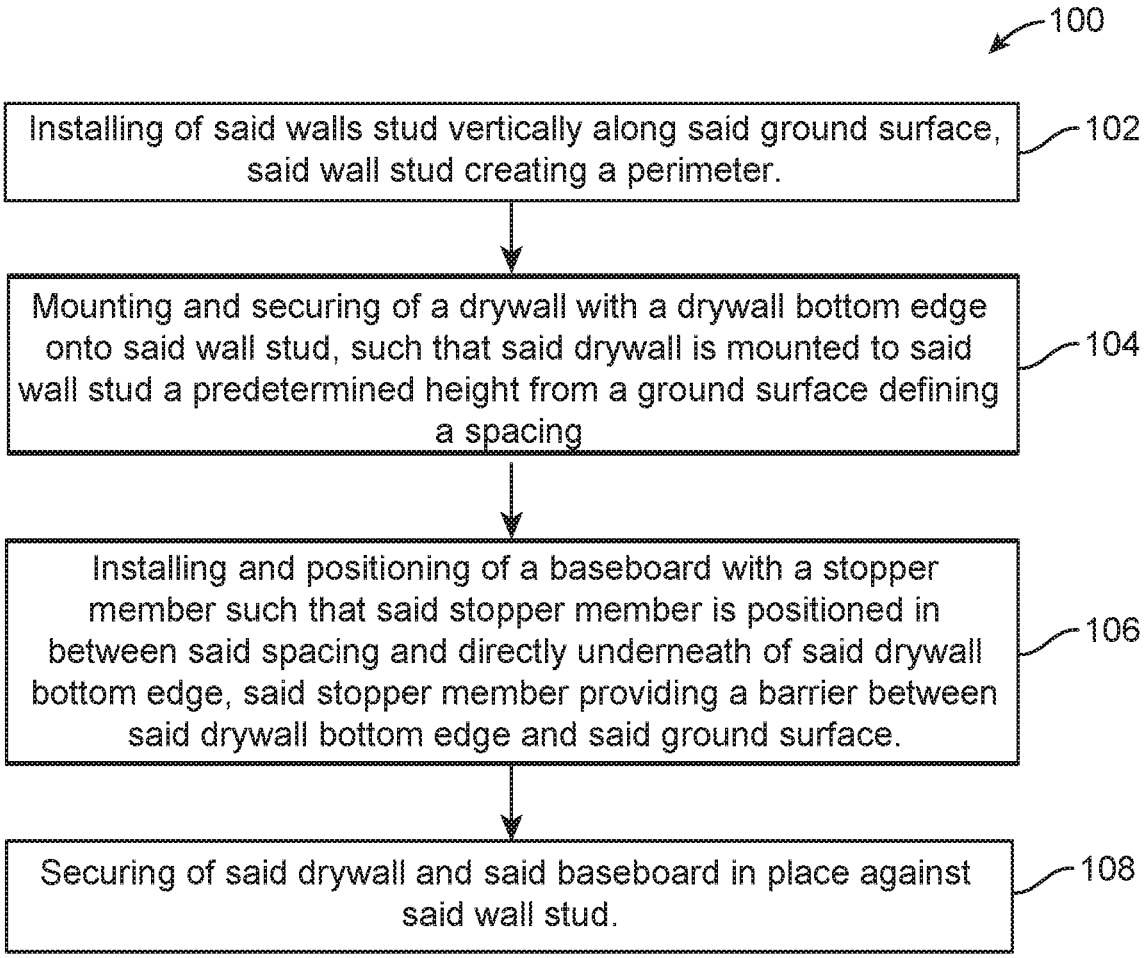

FIG. 9 illustrates the new construction method 100 and the steps necessary to properly install the protective baseboard 10 in a new construction location.

V. DETAILED DESCRIPTION OF THE EMBODIMENTS OF THE INVENTION

Referring now to the drawings, where the present invention is generally referred to with numeral 10, it can be observed that it basically includes a baseboard assembly 20 and a stopper assembly 40.

Baseboards, which may also be referred to as skirting board, skirting, mopboard, floor molding or base molding, are typically used to cover the lowest section of interior walls. Baseboards conceal the intersection between walls and floors. Importantly, baseboards may help to protect drywalls against water damage. Water spilled may be stopped by the baseboards before ever reaching any drywalls. Drywalls coining in contact with water may result in damage to the drywalls, requiring costly repairs.

Baseboard assembly 20 may include a baseboard 22. Baseboard 22 may preferably be mounted upright atop of a ground surface 62 and about a perimeter of a room, as best seen in FIG. 1. Baseboard 22 may have a front side 24 and a rear side 26, as best seen in FIGS. 2 and 3, respectively. Front side 24 may be substantially smooth. Further, baseboard 22 may have a top edge 28 and a bottom edge 32. On front side 24, baseboard 22 may curve rearwardly along top edge 28. Baseboard 22 may be substantially vertical from top edge 28 to bottom edge 32. It can be best seen in FIG. 4, that top edge 28 may preferably be flat or curved. Baseboard 22 may suitably be made of wood, medium density fiberboard, polyvinyl chloride, vinyl board or the like. Baseboard 22 may prevent water damage from occurring to a drywall 64 mounted atop and behind of baseboard 22. Water on ground surface 62 may travel towards and be stopped by baseboard 22 before the water makes contact with drywall 64. It is to be understood that baseboard 22 may be of predetermined dimensions depending on the needs of the user based on the size of the room baseboard 22 is to be installed in. It may be suitable to mount multiple of baseboard 22 together. In an alternate embodiment, baseboard 22 may be whole and extend the entire width of a wall. Additionally, baseboard 22 may be customizable in material and color as per the desires of the user to enhance the desired room. On rear side 26, it can be seen that baseboard includes a spacing 34. Spacing 34 allows for baseboard 22 to be more securely mounted to drywall 64. Spacing 34 improves the gripping of baseboard 22 to drywall 64. Spacing 34 may help to counteract any flexibility in baseboard 22.

Mounted to baseboard 22 may be stopper assembly 40. More specifically, stopper assembly 40 may be mounted to rear side 26 of baseboard 22, as best seen in FIGS. 3-5. It can be seen that stopper assembly 40 includes a stopper member 42. Stopper member 42 may preferably be mounted along bottom edge 32 of baseboard 22. Stopper member 42 may extend outwardly and away from baseboard 22 on rear side 26. Stopper member 42 may be perpendicular to baseboard 22. As best seen in FIG. 5, stopper member 42 may extend an entire width of baseboard 22. It is to be understood that stopper member 42 may extend upwardly a predetermined distance on baseboard 22. In the preferred embodiment, stopper member 42 may be integral with baseboard 22. Stopper member 42 may have a substantially rectangular shape, in one embodiment. However, it is may be suitable for stopper member 42 to be of other shapes as well, as best seen in FIG. 7. Stopper member 42 may be parallel to spacing 34. Additionally, it may be preferable for stopper member 42 to be below spacing 34. Drywall 64 may preferably be mounted atop of stopper member 42. Drywall 64 may include a drywall bottom edge 66. Stopper member 42 may be mounted entirely and directly below drywall bottom edge 66, as best seen in FIG. 6. Stopper member 42 may prevent water from traveling upwardly along drywall 64, to protect drywall 64 from water damage. Stopper member 42 provides a barrier for drywall 64. As best seen in FIG. 6, baseboard 22 and drywall 64 may be secured in place. Preferably, drywall 64 may be secured to wall stud 68 with a fastening member. Baseboard 22 may be secured to drywall 64 with a fastening member or an adhesive. Stopper member 42 may be in constant contact with wall stud 68. It may be suitable to secure baseboard 22 and drywall 64 to wall stud 68 or one another with fastening members such as fasteners, nails, adhesives or the like. Once baseboard 22 and drywall 64 have been secured in place, then stopper member 42 may provide protection and a barrier to drywall 64 from water damage.

It is to be understood that the present invention may employ method 80 for installing protective baseboard 10 when drywall 64 is already in place as walls of a room. Method 80 may include a first step 82, wherein cutting of the bottom of drywall 64 a predetermined height off of ground surface 62 a sufficient height that cooperates with stopper member 42 is done. Thereby resulting in a spacing defined between ground surface 62 and drywall bottom edge 66. Method 80 may further include a second step 84, wherein installing and positioning of baseboard 22 in place occurs, such that stopper member 42 is positioned beneath of drywall bottom edge 66 in between the spacing defined between ground surface 62 and drywall bottom edge 66. It may be suitable for drywall bottom edge 66 to be in abutting contact with the top of stopper member 42. Preferably, stopper member 42 may be entirely and directly atop of stopper member 42. It may also be suitable for drywall bottom edge 66 to be hoovering a predetermined height above of stopper member 42. Stopper member 42 and drywall bottom edge 66 may be parallel to each other. It is to be understood that it may also be suitable for rear side 26 of baseboard 22 to be in abutting contact with drywall 64 as well. Method 80 may also include a third step 86, wherein securing of baseboard 22 and drywall 64 in place occurs. Preferably, drywall 64 may be secured to wall stud 68. Preferably, baseboard 22 may be secured to drywall 64. This helps to ensure that baseboard 22 remains in place to help stopper member 42 prevent water from reaching drywall 64. This is due to stopper member 42 creating a barrier between ground surface 62 and drywall bottom edge 66 to elevate drywall 64 off of ground surface 62 for protecting of drywall 64 from water damage. Resulting in the present invention being successfully being installed in a desired room to protect drywall 64 from any potential costly water damage.

It is to be understood that the present invention may employ new construction method 100 for installing of baseboard 22 in new construction sites or locations. New construction method 100 may be used when drywall 64 is yet to be installed. New construction method 100 may include a step one 102, wherein framing takes place and wall stud 68 is installed to provide stability and structure for the present invention to be mounted thereto. Wall stud 68 may be mounted vertically within a home to provide structure to the desired room, wall stud 68 may be about the perimeter of the desired room. It may be suitable for wall stud 68 to create a room perimeter. In a step two 104 of new construction method 100, mounting and securing of drywall 64 to wall stud 68 occurs. It may be suitable to secure drywall 64 to wall stud 68 with fasteners or fastening members as known in the art. Importantly, during step two 104, drywall 64 may be secured to wall stud 68 a predetermined height above of ground surface 62. Such that a spacing is defined between ground surface 62 and drywall bottom edge 66. New construction method 100 may further include a step three 106, wherein installing and positioning of baseboard 22 in place occurs, such that stopper member 42 is positioned beneath of drywall bottom edge 66 in between the spacing defined between ground surface 62 and drywall bottom edge 66. It may be suitable for drywall bottom edge 66 to be in abutting contact with the top of stopper member 42. Preferably, stopper member 42 may be entirely and directly atop of stopper member 42. It may also be suitable for drywall bottom edge 66 to be hoovering a predetermined height above of stopper member 42. Stopper member 42 and drywall bottom edge 66 may be parallel to each other. It is to be understood that it may also be suitable for rear side 26 of baseboard 22 to be in abutting contact with drywall 64 as well. New construction method 100 may also include a step four 106, wherein securing of baseboard 22 to drywall 64 takes place. This helps to ensure that baseboard 22 remains in place to help stopper member 42 prevent water from reaching drywall 64. This is due to stopper member 42 creating a barrier between ground surface 62 and drywall bottom edge 66 to elevate drywall 64 off of ground surface 62 for protecting of drywall 64 from water damage. Resulting in the present invention being successfully being installed in a desired room to protect drywall 64 from any potential costly water damage.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a baseboard, consisting of:

a. a ground surface;

b. a wall stud vertically mounted along said ground surface;

c. a drywall with a drywall bottom edge;

d. a baseboard assembly including a baseboard, wherein said baseboard includes a rear side and front side, said front side having a first vertical portion, an upper portion of the first vertical portion is connected to a first end of a first portion, a second end of said first portion is connected to a top side of the baseboard, the top side is entirely horizontal, the rear side of the baseboard includes an upper portion, a spacing and a lower portion, wherein said upper portion and said lower portion are vertical, wherein said spacing is defined by a cut along an entire width of the rear side of the baseboard; and e. a stopper assembly including a stopper member that extends outwardly and away from said rear side of said baseboard said stopper member extending the entire width of said baseboard, said stopper member being in constant contact with a wall stud, said stopper member being perpendicular to said baseboard, said stopper member being located on the lower portion of said baseboard, said drywall mounted atop of said stopper member such that said stopper member is entirely and directly beneath of said drywall bottom edge, said drywall and said baseboard being secured in place, said stopper member includes edges.

* * * * *